US006338707B1

(12) United States Patent
Michalik

(10) Patent No.: US 6,338,707 B1
(45) Date of Patent: Jan. 15, 2002

(54) FOLDING APPARATUS OF LOW OVERALL HEIGHT FOR USE IN A WEB-FED ROTARY PRESS

(75) Inventor: Horst Bernhard Michalik, Höchberg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/423,292

(22) PCT Filed: May 9, 1998

(86) PCT No.: PCT/DE98/01293

§ 371 Date: Nov. 9, 1999

§ 102(e) Date: Nov. 9, 1999

(87) PCT Pub. No.: WO98/51498

PCT Pub. Date: Nov. 19, 1998

(30) Foreign Application Priority Data

May 9, 1997 (DE) ..... 197 19 553

(51) Int. Cl.[7] ..... B31B 1/14

(52) U.S. Cl. ..... 493/357; 493/324; 493/344

(58) Field of Search ..... 493/324, 344, 493/345, 361, 362; 270/20.1, 21.1, 41, 44, 57, 6, 7, 8

(56) References Cited

U.S. PATENT DOCUMENTS

| | | | | |
|---|---|---|---|---|
| 658,773 A | | 10/1900 | Goss | 493/429 |
| 2,139,241 A | | 12/1938 | Meyer | 270/32 |
| 4,279,410 A | | 7/1981 | Bolza-Schunemann | 270/6 |
| 4,725,050 A | | 2/1988 | Fujishiro | 270/5 |
| 4,746,107 A | | 5/1988 | Schneider et al. | 270/21.1 |
| 4,754,959 A | | 7/1988 | Kobler et al. | 270/21.1 |
| 4,762,311 A | | 8/1988 | Hertrich | 270/41 |
| 5,242,367 A | * | 9/1993 | Marmin | 493/359 |
| 5,522,586 A | * | 6/1996 | Bennett et al. | 270/8 |
| 5,676,056 A | | 10/1997 | Stein et al. | 101/226 |
| 5,775,222 A | | 7/1998 | Zweifel et al. | 101/227 |

FOREIGN PATENT DOCUMENTS

| | | |
|---|---|---|
| DE | 328284 | 11/1920 |
| DE | 758433 | 7/1933 |
| DE | 1960565 | 12/1969 |
| DE | 2846191 A1 | 4/1980 |
| DE | 3614263 A1 | 10/1987 |
| EP | 0211377 A2 | 8/1986 |
| EP | 0645334 A1 | 9/1994 |
| EP | 0741019 A2 | 4/1996 |
| EP | 0741020 A2 | 4/1996 |

* cited by examiner

*Primary Examiner*—Peter Vo
*Assistant Examiner*—Hemant M. Desai
(74) *Attorney, Agent, or Firm*—Jones, Tullar & Cooper, PC

(57) ABSTRACT

A folding apparatus that is useable in a web-fed rotary printing press has a lower overall structural height. The folding apparatus includes a web delivery device and a folding cylinder group. The folding cylinder group is arranged generally at 90° to the direction of the feed of the material web to the web delivery device, which may include longitudinal fold formers. The material web is directed into the folding cylinder group in an essentially horizontal direction.

18 Claims, 2 Drawing Sheets

FOLDING APPARATUS OF LOW OVERALL HEIGHT FOR USE IN A WEB-FED ROTARY PRESS

FIELD OF THE INVENTION

The present invention relates to a folding apparatus for a web-fed rotary printing press. Folding of the web is accomplished using at least one longitudinal fold former and at least one folding blade cylinder which cooperates with at least one folding jaw cylinder. An axis of rotation of the folding jaw cylinder is above a lower end of the fold former.

DESCRIPTION OF THE PRIOR ART

DE 36 14 263 C2 describes a folding apparatus of a web-fed rotary printing press. This folding apparatus has a collecting cylinder, a cutter cylinder and a folding jaw cylinder.

U.S. Pat. No. 658,773 describes a wheel folding apparatus with a folding blade cylinder, wherein the entry of the web of material takes place below the axis of rotation.

FR-A-758 433 discloses a folding apparatus, wherein a highest point of the surface of a folding jaw cylinder is approximately at the height of a former protrusion of a longitudinal fold former.

EP-0 211 377 A2 discloses a folding apparatus with a folding jaw cylinder and two folding blade cylinders, wherein one folding blade cylinder is located below an axis of rotation of the folding jaw cylinder.

DE-C-328 284 shows a wheel folding apparatus, wherein the folding blade cylinder is located above a protrusion of a longitudinal former.

SUMMARY OF THE INVENTION

The present object of the invention is based on creating a folding apparatus for a web-fed rotary printing press.

In accordance with the invention, this object is attained by the provision of a folding apparatus that includes at least one longitudinal fold former, at least one folding blade cylinder, and at least one folding jaw cylinder that cooperates with the folding blade cylinder. The axis of rotation of the folding jaw cylinder is located above the lower end of the longitudinal fold former.

The advantages which can be achieved by means of the present invention reside, in particular, in that a low structural height is achieved for a group of folding cylinders, including a device for delivering the web of material. In turn, this results in much improved user friendliness. Moreover, the folding cylinder group can be rapidly varied by the use of different modules.

BRIEF DESCRIPTION OF THE DRAWINGS

A preferred embodiment of the present invention is represented in the drawings and will be described in greater detail in what follows. Shown are in.

DESCRIPTION OF THE PREFERRED EMBODIMENT

Figure 1:
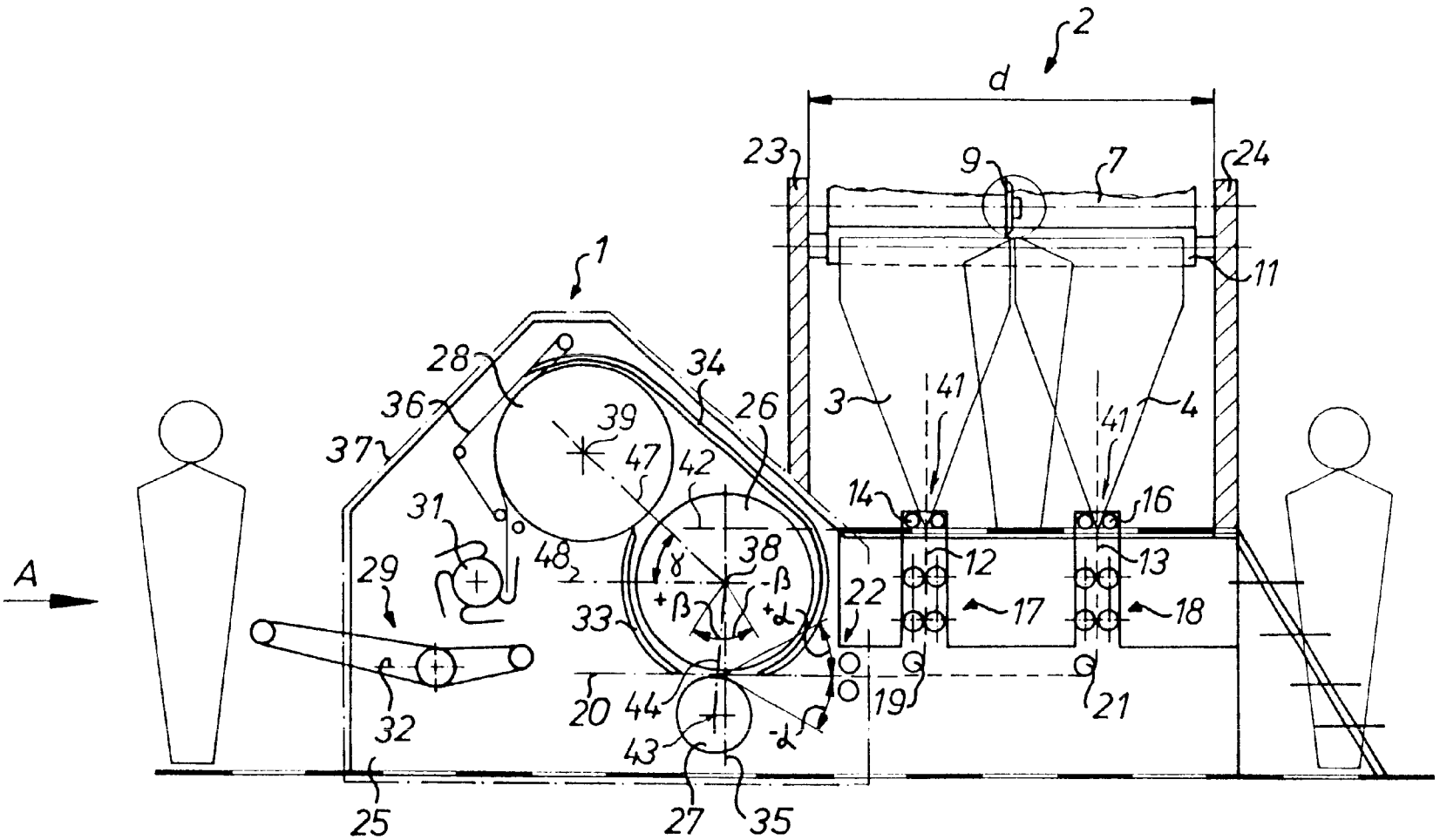
FIG. 1, a schematic side elevation view of a folding apparatus with longitudinal fold formers and a folding cylinder group, FIG. 2, an end view taken in the direction A in accordance with FIG. 1, but without the conveying device, and in FIG. 3, a top plan view from above in accordance with FIG. 1.
Figure 3:
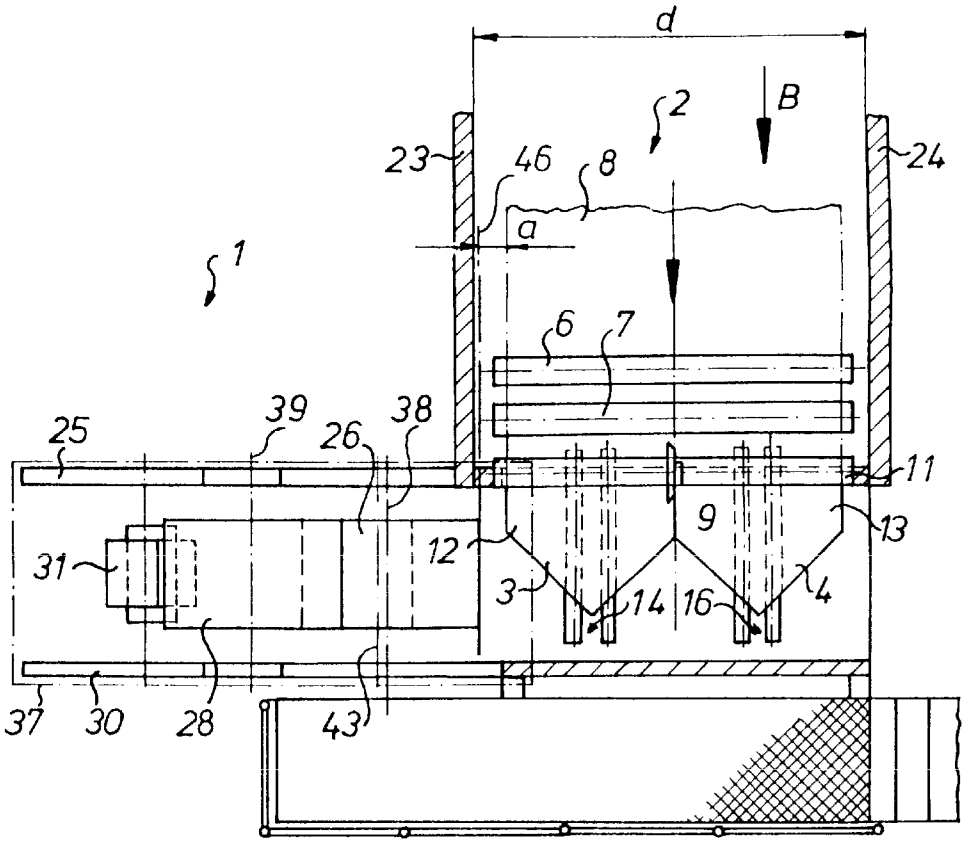
Figure 2:
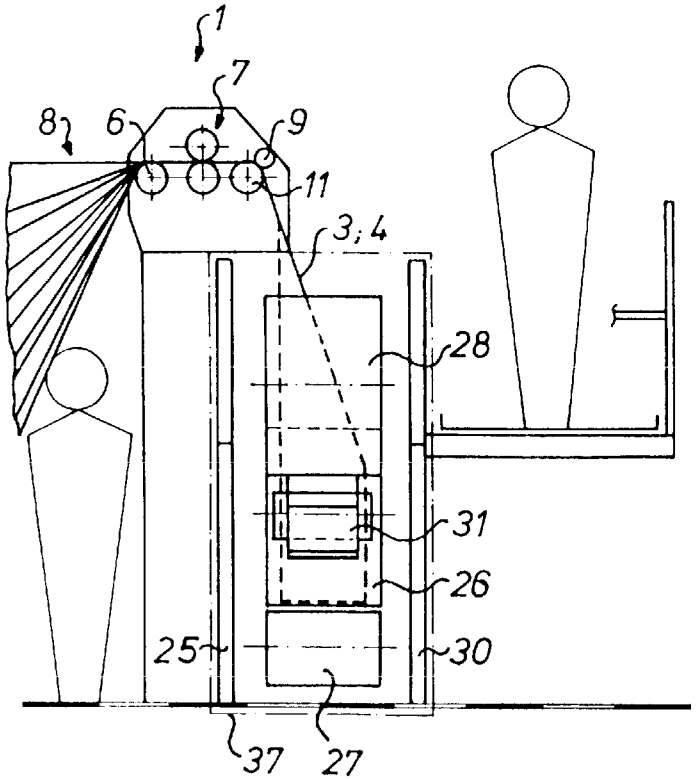

A folding apparatus for a web-fed rotary printing press, as seen in FIG. 1 essentially consists of a folding cylinder group 1 and a device 2, arranged upstream, viewed in the running direction B of the web of material as shown in FIG. 3, of the folding cylinder group 1, for delivering a web 8 of material.

The device 2 for delivering a web 8 of material consists, for example, of two longitudinal fold formers 3, 4, to which the web 8 of material, which may be, for example a paper web or a train of paper webs, is delivered via a combination roller 6 and a drawing unit 7. The device 2 for delivering the train can consist of a number of the two depicted turning bars arranged on top of each other, instead of longitudinal fold formers 3, 4.

Prior to entering the former, the web 8 of the two depicted material can be divided into several partial webs 12, 13 of material by means of a longitudinal cutting device, which consists of a circular cutter 9 and a counter-cutting roller 11. However, it is also possible to supply the drawing device 7 with already cut partial webs 12, 13 of material.

Drawing units 17, 18 are located below the pairs of fold former rollers 14, 16 of each longitudinal fold former 3, 4. Guide roller 19, 21, around which the respective partial webs 12, 13 of material are deflected by approximately 90° are, located after the drawing units 17 and 18. From the guide rollers 19, 20, the partial webs 12, 13 are delivered to the folding cylinder group 1 in a horizontal or nearly horizontal direction by means of a common drawing unit 22. The fold former rollers 14, 16 of the longitudinal fold formers 3, 4 are located at approximately half of the total height of the folding cylinder group, as seen in FIG. 1.

At least one of the guide rollers 19, 21 can be embodied as a cut register roller 21.

It is also possible to arrange the guide rollers 19, 21 in such a way that the partial webs 12, 13 of material enter the folding cylinder group 1 at an angle $\alpha$ in the range of ±35° in respect to a horizontal line 20. Here, the entry of the partial webs 12, 13 of material takes place through an inlet wedge of a pair of cylinders with a least one paper-conveying cylinder which is, in this case, a collecting cylinder 26. A nearly horizontal entry here means an entry at an angle $\alpha$ in the range of ±5° in respect to a horizontal line 20, all as shown in FIG. 1.

The guide rollers 19, 21 can also be designed to be considerably larger than represented in FIG. 1, i.e. their diameter can be larger than 200 mm, for example.

It is also possible to arrange a curved guide plate, which can be supplied with compressed air and whose radius of curvature is greater than 100 mm, for example, in place of the guide roller.

It is also possible to arrange a plurality of guide rollers along a curved track.

A "gentle" or gradual transition from the vertical direction of running of the partial web 12, 13 of material into the horizontal direction of running is achieved by means of these above described devices.

The device 2 for delivering the web 8 of material is supported between lateral frames 23, 24, which are arranged with a clear width d. The folding cylinder group 1 is arranged at right angles to the running direction B of the material in lateral frames 25, 30, as may be seen in FIG. 3.

In accordance with a first, preferred embodiment of the present invention, the folding cylinder group 1 consists, for example, of a folding blade cylinder 26, which, in addition, is operable as a collecting cylinder 26, and a cutter cylinder 27 arranged below the collecting cylinder 26. In the first preferred embodiment, the folding blade cylinder 26 also operates as a counter-cutting cylinder. A folding jaw cylinder 28 and a delivery device 29 are also assigned to the collecting cylinder 26. The delivery device 29 can consist of a fan delivery device 31 and a conveying device 32, such as, for example a belt delivery device as depicted in FIG. 1.

In place of a fan delivery device 31 it is possible to use a delivery cylinder, such as a so-called slow down cylinder. This folding cylinder group 1 depicted in FIG. 1, is particularly suited to newspaper production.

Rod- or belt-shaped product guide devices 33, 34, 36 are positioned about to the circumference of the collecting cylinder 26 and the folding jaw cylinder 28 as seen in FIG. 1.

The folding cylinder group 1 is preferably disposed in a module 37 as represented by dash-dotted lines in FIG. 1. One such module can be exchanged for another module in a short time.

In accordance with a second preferred embodiment, not specifically represented, another module 37 of a folding cylinder group 1 for so-called "double production" of particularly thin, preferably different products of a large delivery height consists of a collecting cylinder 26 with a cutter cylinder 27 arranged under it and first and second folding blade cylinders assigned to the collecting cylinder. A separate delivery device 29 is assigned to each folding blade cylinder.

In accordance with a third, also not represented preferred embodiment, a further module 37 of a folding cylinder group 1 for jobbing production with a plurality of product variations can consist, for example, of a collecting cylinder 26 with a cutter cylinder 27 arranged under it, a first transverse folding cylinder assigned to the collecting cylinder, and a second transverse folding cylinder assigned to the first transverse folding cylinder, as well as a delivery device assigned to the second transverse folding cylinder. The folded products leaving the second transverse folding cylinder can also be conducted to a second longitudinal folding device, instead of to the previously mentioned delivery device.

A straight line 44, defined by an axis of rotation 43 of the cutter cylinder 27 and by an axis of rotation 38 of the collecting cylinder 26, and a vertical line 35 extending through the axis of rotation 38 of the collecting cylinder 26, are arranged at an angle $\beta$ with respect to each other in the range of ±35°. The axis of rotation 43 of the cutter cylinder 27 is arranged below the axis of rotation 38 of the collecting cylinder 26, as may be seen in FIG. 1. The cutter cylinder 27 is preferably arranged almost vertically below the collecting cylinder 26, i.e. wherein the range of the angle $\beta$ is about ±5°.

With each of the three above described preferred embodiments it is furthermore possible to assign a stapling apparatus to the collecting cylinder 26.

An axis of rotation 39 of the folding jaw cylinder 28 is situated above a straight line 42 extending through a lower end or a lower edge of a protrusion 41 of the longitudinal fold former 3, 4, which protrusion 41 is preferably the lowest.

In a top plan view of the folding apparatus, as presented in FIG. 3 a straight line 46 through a circumferential edge of the collecting cylinder 26 facing a lateral edge of the web 8 of material, and a nearest side edge of a web 8 of material entering the longitudinal fold former 3 are at a distance a.

Further longitudinal fold formers can be arranged above the longitudinal fold formers 3, 4.

A straight line 47, defined by the axis of rotation 38 of the collecting cylinder 26 and by the axis of rotation 39 of the folding jaw cylinder 28, and a horizontal line 48 extending through the axis of rotation 38 of the collecting cylinder 26, intersect at an opening angle $\gamma$ of between 30° to 60°, and preferably between 40° to 50°.

The axis of rotation 38 of the collecting cylinder 26 is arranged below the axis of rotation 39 of the folding jaw cylinder 28.

The axes of rotation 38, 39 of the collecting cylinder 26 and of the folding jaw cylinder 28 are arranged parallel to each other and to the running direction B of the web 8 of material.

While preferred embodiments of a folding apparatus in accordance with the present invention have been set forth fully and completely hereinabove, it will be apparent to one of skill in the art that a number of changes in, for example, the numbers of webs of material fed to the longitudinal fold formers, the type of printing press used, and the like could be made without departing from the true spirit and scope of the present invention which is accordingly to be limited only by the following claims.

What is claimed is:

1. A folding apparatus for a web-fed rotary printing press comprising:

at least one longitudinal fold former for receiving a web of material and for forming a longitudinal fold in the web of material, said at least one longitudinal fold former having an upper end for receipt of the web of material, and a lower end for discharge of the longitudinally formed web of material, said lower end of said at least one longitudinal fold former being located at a first level in said folding apparatus;

a folding cylinder group in said folding apparatus, said folding cylinder group including at least one cutter cylinder, one folding blade cylinder and one folding jaw cylinder, said at least one folding jaw cylinder cooperating with said folding blade cylinder to fold web segments received from said folding blade cylinder and formed from the longitudinally formed web received from said at least one longitudinal fold former and cut into the web segments by said cutter cylinder and said folding blade cylinder; an axis of rotation of said at least one folding jaw cylinder, said axis of rotation of said folding jaw cylinder being located at a second level, said second level being located above said first level in said folding apparatus and above a horizontal line extending through said lower end of said at least one longitudinal former.

2. The folding apparatus of claim 1 further including fold former rollers receiving the longitudinally formed web of material from said at least one longitudinal fold former, each of said fold former rollers having an axis of rotation, said folding jaw cylinder axis of rotation being above said fold former roller axis of rotation.

3. The folding apparatus of claim 1 wherein said folding blade cylinder has an axis of rotation and further wherein entry of the longitudinally formed web of material to said folding blade cylinder is below said folding blade cylinder axis of rotation.

4. The folding apparatus of claim 3 wherein said entry of the longitudinally formed web of material to said folding blade cylinder is at an entry angle of +35° with respect to a horizontal line.

5. The folding apparatus of claim 3 wherein said entry of the longitudinally formed web of material to said folding blade cylinder is at an entry angle of +5° with respect to a horizontal line.

6. The folding apparatus of claim 1 further wherein said cutter cylinder has a cutter cylinder axis of rotation, said cutter cylinder axis of rotation being located below an axis of rotation of said folding blade cylinder.

7. The folding apparatus of claim 6 further wherein a straight line defined by said folding blade cylinder axis of rotation, and said cutter cylinder axis of rotation, and a vertical line passing through said folding blade cylinder axis of rotation define an angle in the range of ±35°.

8. The folding apparatus of claim 1 wherein a straight line defined by an extension of a surface of said folding blade cylinder and a nearest lateral edge of a web entering said at least one longitudinal fold former are spaced at a distance from each other.

9. The folding apparatus of claim 1 wherein said folding cylinder group is arranged in an exchangeable module.

10. A folding apparatus for a web-fed printing press, said folding apparatus having a folding cylinder group including a first folding blade cylinder for folding a web received in said folding cylinder group, and at least one folding jaw cylinder, arranged downstream, in a web travel direction, from said first folding blade cylinder, and wherein entry of a web of material into said first folding blade cylinder takes place below an axis of rotation of said first folding blade cylinder and at an entry angle of ±35 with respect to a horizontal line.

11. The folding apparatus of claim 10 wherein said axis of rotation of said first folding blade cylinder is below an axis of rotation of said folding jaw cylinder.

12. The folding apparatus of claim 10 wherein a straight line defined by said axis of rotation of said first folding blade cylinder, and said folding jaw cylinder, and a horizontal line extending through said axis of rotation of said folding blade cylinder define an angle of between 30° and 60°.

13. The folding apparatus of claim 10 wherein said folding cylinder group further includes a cutter cylinder cooperating with and positioning below said folding blade cylinder, and a delivery device.

14. The folding apparatus of claim 10 wherein said folding cylinder group further includes a cutter cylinder associated with and positioned below said first folding blade cylinder, and first and second folding jaw cylinders, each of said first and second folding jaw cylinders having an associated delivery device.

15. The folding apparatus of claim 10 wherein said folding cylinder group further includes a cutter cylinder associated with, and positioned below said first folding blade cylinder, and first and second transverse folding cylinders and an associated delivery device.

16. The folding apparatus of claim 15 wherein said delivery device includes a fan delivery device and a conveying device.

17. The folding apparatus of claim 15 wherein said delivery device includes a delivery cylinder and a conveying device.

18. The folding apparatus of claim 10 wherein said folding cylinder group is arranged in an exchangeable module.

* * * * *